US006263856B1

(12) United States Patent
Weber et al.

(10) Patent No.: US 6,263,856 B1
(45) Date of Patent: Jul. 24, 2001

(54) POWERTRAIN OUTPUT MONITOR

(75) Inventors: Charles Francis Weber, South Lyon; Allan Joseph Kotwicki, Williamsburg; Ross Dykstra Pursifull, Dearborn, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/488,301

(22) Filed: Jan. 20, 2000

(51) Int. Cl.[7] ..... F02D 43/04

(52) U.S. Cl. ..... 123/352; 123/361; 123/406.47; 123/406.52; 123/478; 123/568.21

(58) Field of Search ..... 123/352, 361, 123/399, 406.47, 406.52, 478, 479, 480, 568.21; 73/119 A; 701/104, 107

(56) References Cited

U.S. PATENT DOCUMENTS

| | | | | |
|---|---|---|---|---|
| 3,863,054 | * | 1/1975 | Monpetit | 701/104 |
| 4,094,274 | | 6/1978 | Harada et al. | 123/493 |
| 4,220,059 | * | 9/1980 | Mizuno et al. | 477/68 |
| 4,635,607 | | 1/1987 | Yasuoka et al. | 123/479 |
| 4,748,955 | | 6/1988 | Yonekawa et al. | 123/479 |
| 4,890,590 | | 1/1990 | Iwamoto et al. | 123/198 D |
| 4,903,669 | * | 2/1990 | Groff et al. | 123/478 |
| 5,048,481 | | 9/1991 | Chan et al. | 123/333 |
| 5,048,482 | | 9/1991 | Kratt et al. | 123/333 |
| 5,074,267 | | 12/1991 | Ironside et al. | 123/399 |
| 5,079,946 | | 1/1992 | Motamedi et al. | 73/118.1 |
| 5,146,892 | | 9/1992 | Krampe et al. | 123/399 |
| 5,204,816 | | 4/1993 | Wright et al. | 701/114 |
| 5,255,653 | | 10/1993 | Ironside et al. | 123/399 |
| 5,370,094 | | 12/1994 | Sorg et al. | 123/399 |
| 5,391,127 | | 2/1995 | Nishimura | 477/110 |
| 5,429,091 | | 7/1995 | Huber et al. | 123/399 |
| 5,623,905 | | 4/1997 | Kau et al. | 123/361 |
| 5,687,694 | * | 11/1997 | Kanno | 123/479 |
| 5,692,472 | | 12/1997 | Bederna et al. | 123/350 |
| 5,732,381 | * | 3/1998 | Guido et al. | 701/104 |

* cited by examiner

*Primary Examiner*—Tony M. Argenbright
(74) *Attorney, Agent, or Firm*—Allan J. Lippa

(57) ABSTRACT

A powertrain control method for an internal combustion engine responsive to an accelerator pedal input, the engine having at least one fuel injector responsive to a commanded fuel signal. The method comprises the steps of determining the engine speed, determining the accelerator pedal position, and generating a desired fuel quantity value as a function of the accelerator pedal position and engine speed. If the commanded fuel signal is greater than the desired fuel quantity value, the commanded fuel signal is limited to the desired value.

15 Claims, 2 Drawing Sheets

POWERTRAIN OUTPUT MONITOR

BACKGROUND OF THE INVENTION

The invention relates generally to control systems for internal combustion engines, and more particularly, concerns a powertrain output monitor for electronic throttle control-equipped vehicles.

Present powertrain output monitor techniques typically compute an estimate of engine output and compare that value to the requested engine output. Such methods typically take the form of resolving one or more engine operating parameters and comparing the estimated versus requested output value. Such operating parameters can include: engine output torque, engine output power, wheel torque, wheel power, and wheel acceleration. The requested output is typically a function of driver demand as measured by the accelerator pedal position, combined with internally automated demands such as idle speed control and catalyst heating.

Due to the complex nature of determining estimated and requested engine output as a function of one or more engine operating characteristics and driver inputs, diagnostics based upon such monitoring techniques are inherently complex. Therefore, there exists a need for a simplified method of monitoring the powertrain control system.

In cases where engines are designed for optimum fuel efficiency (i.e., variable valve timing, lean burn, direct injected spark-ignited, high EGR rates), fuel is the variable most directly related to engine torque (fuel quantity injected per stroke) or power (fuel rate). Accordingly, there is a need for a powertrain output monitoring method relating to engine fuel flow.

SUMMARY OF THE INVENTION

In view of the foregoing, it is an object of the invention to provide an improved method of monitoring the powertrain output. It is also an object to provide a simplified powertrain output monitor as compared to present output monitoring technologies.

According to the present invention, the foregoing and other advantages are attained by a method of monitoring the powertrain controller for an internal combustion engine responsive to an accelerator pedal input, the engine having at least one fuel injector responsive to a commanded fuel signal. The method comprises the steps of determining the engine speed, determining the accelerator pedal position, and generating a desired fuel quantity value. If the commanded fuel signal is greater than the desired fuel quantity value, the commanded fuel signal is set equal to the desired fuel quantity value.

In one aspect of the invention, the desired fuel quantity value is generated as a function of the accelerator pedal position. In another aspect, the desired fuel quantity value is generated as a function of the accelerator pedal position and engine speed. If the commanded fuel signal is greater than the desired fuel quantity value, the commanded fuel signal is limited to the desired value, or other powertrain control action is taken. Such action can include modifying spark timing, or modifying the throttle actuator.

An advantage of the present invention is that little or no field calibration is required. Another advantage is that few inputs are necessary, thus, the main control element interface is simplified.

Other advantages of the invention will become apparent upon reading the following detailed description and appended claims, and upon reference to the accompanying drawings.

BRIEF DESCRIPTION OF THE DRAWINGS

For a more complete understanding of this invention, reference should now be had to the embodiments illustrated in greater detail in the accompanying drawings and described below by way of examples of the invention. In the drawings.

DETAILED DESCRIPTION OF THE PREFERRED EMBODIMENT

Figure 1:
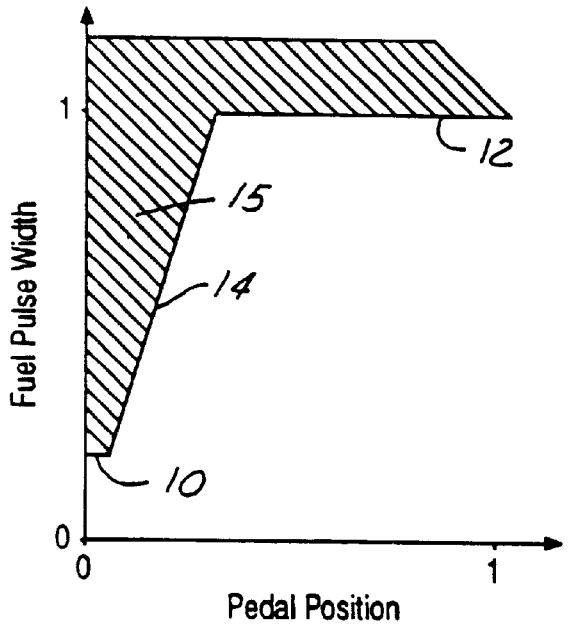
FIG. 1 is a graph of fuel pulsewidth versus accelerator pedal positions.

Turning first to FIG. 1, there is shown a graph of the fuel pulsewidth versus accelerator pedal position for an engine operating in steady state. As can be seen with reference to region 10 which corresponds to an accelerator pedal position of zero (i.e., the operator's foot is off-pedal), the fuel pulsewidth should be near its minimum. In other words, it is undesirable to deliver a large quantity of fuel when in the foot-off-pedal condition since fuel flow correlates to power and fuel quantity relates to torque. Accordingly , the fuel pulsewidth, at foot-off-pedal, preferably is no greater than the maximum fuel pulsewidth required for the highest idle torque desired. This corresponds to the region 10 in FIG. 1.

Similarly, when the accelerator pedal is equal to 1.0, i.e., fully deflected, the fuel pulsewidth is limited to its maximum value. This is represented by region 12 in FIG. 1.

Also, when the pedal position transitions from 0.0 (foot-off-pedal) to an intermediate position such as 0.2, the fuel pulsewidth should not immediately be commanded to its maximum flow. Thus, the region 14 should correlate to a desired pedal-to-torque gain for the particular engine under consideration.

Figure 2:
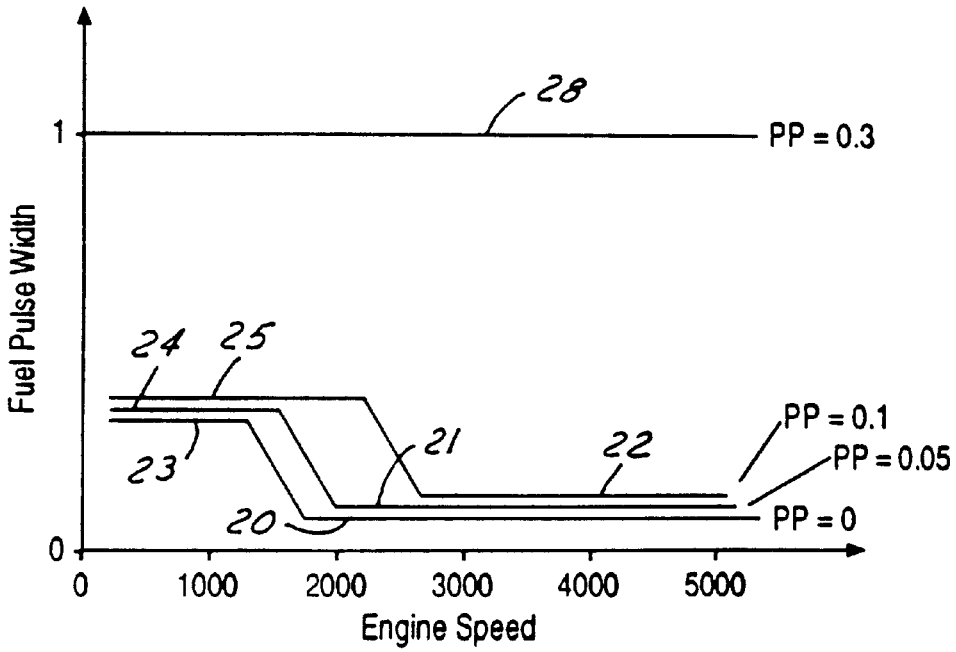
FIG. 2 is a graph of fuel pulsewidth versus engine speed for various accelerator pedal positions.

FIG. 2 shows graphically a similar relationship for the fuel pulsewidth as it relates to engine speed and accelerator pedal position. When the pedal position (PP) is 0.0 (foot-off-pedal), and the engine speed is above 1600 RPM, the fuel pulsewidth is minimized as shown as point 20 of FIG. 2. Similarly, when the pedal position is nearly closed (PP=0.05) and the engine is operating above 2000 RPM, the fuel pulsewidth is minimized as shown at point 21. The difference between the minimum fuel pulsewidth value for the various pedal positions, i.e., between points 20, 21 and 22, allows for engine braking modulation. In this example, the more pedal deflections, the less engine braking desired. Similarly, the regions 23, 24 and 25 correspond to the maximum fuel pulsewidth for near idle conditions. Beyond a certain pedal position such as PP=0.3, the fuel pulsewidth is preferably maximized to allow for the greatest amount of torque. This is shown in FIG. 2 as line 28.

From the foregoing graphs illustrated in FIGS. 1 and 2, a relationship can be seen between accelerator pedal position and fuel pulsewidth from which an effective engine output monitoring scheme can be created.

Figure 3:
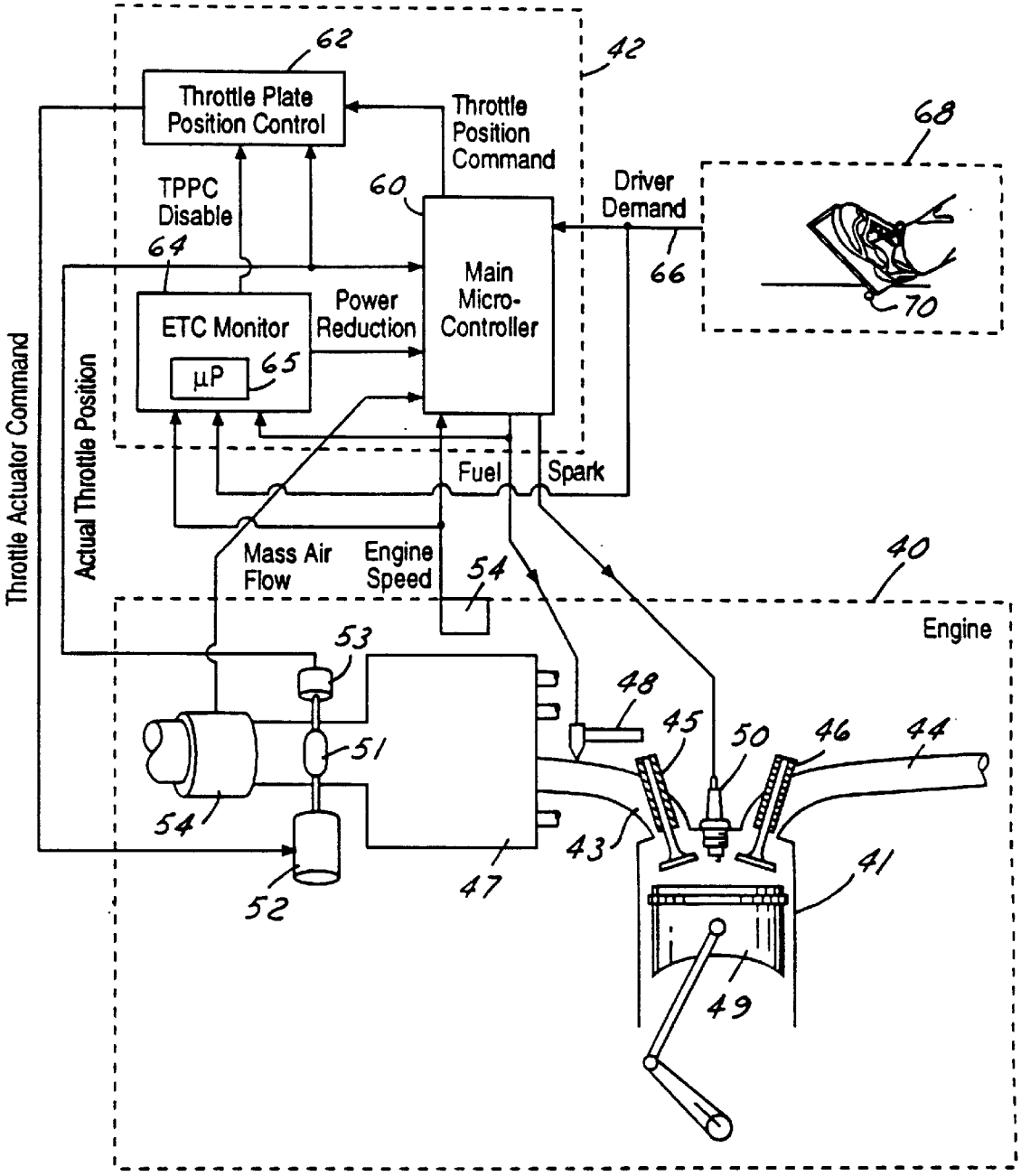
FIG. 3 is a schematic diagram of an internal combustion engine and associated control system according to one embodiment of the present invention.

Referring now to FIG. 3, there is shown a schematic diagram of an internal combustion engine 40 and associated powertrain control module 42 as well as an operator interface 68 in accordance with one embodiment of the present invention.

The engine 40 includes a plurality of combustion chambers 41 each having an associated intake 43 and exhaust 44 operated by respective valves 45, 46. Combustion occurs as a result of the intake of air and fuel from the intake manifold 47 and fuel injector 48 respectively, compression by the piston 49 and ignition by the spark plug 50. Combustion gases travel through the exhaust manifold 44 to the downstream catalytic converter and are emitted out of the tailpipe. A portion of the exhaust gases may also be recirculated back through the intake manifold 47 to the engine cylinders 41.

The airflow through the intake manifold 47 is controlled by a throttle comprising a throttle plate 51 and throttle actuator 52. A throttle position sensor 53 measures the actual throttle position. Mass airflow sensor 54 measures the amount of air flowing into the engine 40. An engine speed sensor 54 provides value indicative of the rotational speed of the engine 40.

The powertrain control module (PCM) 42 receives as inputs the throttle position signal, the mass airflow signal, the engine speed signal, and the driver demand inputs. In response, the PCM 42 controls the spark timing of the spark plugs 50, the pulse width of fuel injectors 48 and the position of the throttle 51 by way of the throttle actuator 52. All of these inputs and outputs are controlled by the main microcontroller 60. The main microcontroller 60 controls the throttle position by outputting a throttle position command to the throttle plate position controller 62 to drive the throttle actuator 52 to the desired position.

The PCM 42 includes an electronic throttle control (ETC) monitor 64 which communicates with the main microcontroller 60 and throttle plate position controller 62. The ETC monitor 64 includes a microprocessor 65 and associated memory separate from the microprocessor in the main microcontroller 60. The ETC monitor 64 receives as inputs the engine speed signal from engine speed sensor 54, and the driver demand signal 66 which represents, among other things, the accelerator pedal position 70. As will be described in further detail below, the ETC monitor 64 monitors the commanded fuel pulsewidth.

The PCM 42 also receives as an input driver demand signals 66. The driver demand signals can include such things as accelerator pedal position 70, ignition switch position, steering input, brake sensor, transmission position input, as well as inputs from the speed control or cruise control system.

In operation, the ETC monitor 64 monitors the accelerator pedal position and engine speed separate from the main microcontroller 60 which executes the primary engine control. In this case, the function of the ETC monitor 64 is to detect fuel pulsewidth commands as defined by the regions, such as region 15, discussed above with respect to FIGS. 1 and 2.

From the inputs of engine speed and accelerator pedal position (PP), the ETC monitor generates a desired fuel quantity value. The fuel quantity value corresponds to the graphs of FIGS. 1 and 2. Accordingly, a first fuel quantity value is determined as a function of pedal position along as shown in FIG. 1. A second fuel quantity value is then determined as shown in FIG. 2 for the measured pedal position and engine speed. The fuel quantity value is then clipped to the lesser of the first and second fuel quantity values.

If the commanded fuel quantity is greater than the fuel quantity value, action may be taken. The action can take the form of limiting the commanded fuel quantity for the fuel quantity value or can include retarding the spark timing of the spark plugs 50, or modifying the throttle position command signal or varying the amount of exhaust gas recirculation.

Additionally, if the fuel quantity value is exceeded, an indicator can be illuminated on the instrument panel of the vehicle to alert the operator.

From the foregoing, it will be seen that there has been brought to the art a new and improved powertrain control monitor. While the invention has been described in connection with one or more embodiments, it will be understood that the invention is not limited to those embodiments. On the contrary, the invention covers all alternatives, modifications, and equivalents, as may be included within the spirit and scope of the appended claims.

What is claimed is:

1. A method of monitoring the powertrain output controller for an internal combustion engine responsive to an accelerator pedal input, said engine having at least one fuel injector responsive to a commanded fuel signal and an engine speed sensor for providing an engine speed signal, the method comprising the steps of:

determining the accelerator pedal position;

generating a desired fuel quantity value as a function of the accelerator pedal position; and if the commanded fuel signal is greater than the desired fuel quantity value, then generating a commanded fuel signal equal to the desired fuel quantity value.

2. The monitoring method of claim 1 wherein the step of generating a desired fuel quantity value includes the step of generating a first fuel quantity value as a function of the accelerator pedal position only.

3. The monitoring method of claim 2 wherein the step of generating a desired fuel quantity value includes the steps of generating a second fuel quantity value as a function of the accelerator pedal position and engine speed and setting the desired fuel quantity value to the lesser of the first and second fuel quantity values.

4. A method of monitoring the powertrain output controller for an internal combustion engine responsive to an accelerator pedal input, said engine having at least one fuel injector responsive to a commanded fuel signal, at least one spark plug responsive to a spark timing signal, a throttle responsive to a throttle position command signal, an exhaust gas recirculation passage, and a speed sensor for providing an engine speed signal the method comprising the steps of:

determining the accelerator pedal position;

generating a desired fuel quantity value as a function of the accelerator pedal position; and if the commanded fuel signal is greater than the desired fuel quantity value, then adjusting the power delivered by the engine.

5. The monitoring method of claim 4 wherein the step of generating a desired fuel quantity value includes the step of generating a first fuel quantity value as a function of the accelerator pedal position only.

6. The monitoring method of claim 5 wherein the step of generating a desired fuel quantity value includes the steps of generating a second fuel quantity value as a function of the accelerator pedal position and engine speed and setting the desired fuel quantity value to the lesser of the first and second fuel quantity values.

7. The monitoring method of claim 4 wherein the step of adjusting the power delivered by the engine includes the step of modifying the throttle position command signal.

8. The monitoring method of claim 4 wherein the step of adjusting the power delivered by the engine includes the step of modifying the amount of exhaust gas recirculated into the engine.

9. The monitoring method of claim 4 wherein the step of adjusting the power delivered by the engine includes the step of modifying the spark timing signal.

10. A control system for an internal combustion engine responsive to an accelerator pedal input, said engine having at least one fuel injector responsive to a commanded fuel signal, at least one spark plug responsive to a spark timing signal and a throttle responsive to a throttle position command signal, the system comprising:

an accelerator pedal position sensor for providing an accelerator pedal position value;

an engine speed sensor for providing an engine speed value;

a control unit including a microprocessor for receiving the accelerator pedal position value and engine speed value, the microprocessor programmed to perform the following steps:

generate a desired fuel quantity value; and if the commanded fuel value is greater than the desired fuel quantity value, then generate a commanded fuel signal to equal to the desired fuel quantity value.

11. The control system of claim 10 wherein the desired fuel quantity signal is generated as a function of a first and second fuel quantity value, said first fuel quantity value being generated as a function of the accelerator pedal position value and said second fuel quantity value being generated as a function of the accelerator pedal position value and engine speed value.

12. A method for a powertrain controller for an internal combustion engine responsive to an accelerator pedal input, said engine having at least one fuel injector responsive to a commanded fuel signal, at least one spark plug responsive to a spark timing signal, a throttle responsive to a throttle position command signal, an exhaust gas recirculation passage, and a speed sensor for providing an engine speed signal the method comprising the steps of:

determining the accelerator pedal position;

generating a desired fuel quantity value as a function of the accelerator pedal position; and if the commanded fuel signal is greater than the desired fuel quantity value, then indicating the same.

13. The method of claim 12 wherein the step of generating a desired fuel quantity value includes the step of generating a first fuel quantity value as a function of the accelerator pedal position only.

14. The method of claim 13 wherein the step of generating a desired fuel quantity value includes the steps of generating a second fuel quantity value as a function of the accelerator pedal position and engine speed and setting the desired fuel quantity value to the lesser of the first and second fuel quantity values.

15. The method of claim 12 wherein the step of indicating includes the step of illuminating an indicator on an operator instrument panel for the engine.

* * * * *